US006093024A

United States Patent [19]

Sokolowski

[11] Patent Number: 6,093,024

[45] Date of Patent: Jul. 25, 2000

[54] SUSPENDED MOTOR-SKILL TRAINING APPARATUS

[76] Inventor: Michelle M. Sokolowski, 3429 Fenwick Cresent, Mississauga, Ontario, Canada, L5L 5N7

[21] Appl. No.: 09/094,657

[22] Filed: Jun. 15, 1998

[51] Int. Cl.[7] ..... A63G 9/00

[52] U.S. Cl. ..... 434/247; 482/43; 297/274

[58] Field of Search ..... 434/247; 297/273–275, 297/276–282, 5; 482/23, 35, 43; D6/333–335, 500–502

[56] References Cited

U.S. PATENT DOCUMENTS

| | | | |
|---|---|---|---|
| D. 302,360 | 7/1989 | Riehm . | |
| D. 336,994 | 7/1993 | Mitchell et al. . | |
| D. 376,264 | 12/1996 | Cone et al. . | |
| 3,721,437 | 3/1973 | Skaricic . | |
| 4,844,452 | 7/1989 | Tomosky et al. | 297/274 |
| 5,409,246 | 4/1995 | Ali | 297/274 |
| 5,445,585 | 8/1995 | Meeker . | |

*Primary Examiner*—Glenn E. Richman

[57] ABSTRACT

A suspended motor-skill training apparatus comprises a substantially solid and weighty main body member defining in horizontally surrounding relation a hollow central region open for vertical passage therethrough and sized to permit the legs and pelvis of a trainee to pass therethrough. The main body member has left and right forwardly disposed attachment points and a rearwardly disposed attachment point defining a geometric center disposed within the hollow central region, and a center of gravity disposed substantially centrally between and rearwardly of the left and right forwardly disposed attachment points. Strap members connect the attachment points to a suspension mechanism mounted on an elevated support structure. A seat depends from the main body member such that the pelvic area of a trainee is received by the seat below the main body member and such that the center of gravity of the trainee is at an elevation adjacent or below the main body member. When the trainee leans outwardly, the trainee is physically precluded from falling out of the training apparatus by the main body member. The combined center of gravity of the trainee and the main body member remains within the triangle defined by the attachment points at an elevation adjacent or below the main body member, thus precluding the suspended motor-skill training apparatus from tipping more than a minor amount. Gross motor skills can be learned through repetitive motion, with the risks of injury and falling out being precluded.

19 Claims, 4 Drawing Sheets

SUSPENDED MOTOR-SKILL TRAINING APPARATUS

FIELD OF THE INVENTION

This invention relates to motor skills training apparatus, and more particularly to such training apparatus that are suspended from an elevated support structure and permits a human trainee to directly practice and learn gross motor skills.

BACKGROUND OF THE INVENTION

In order for an infant to learn gross motor and other skills, it is preferable that the infant initially observe the task being performed (tertiary learning), and then is co-manipulated to perform the task (secondary learning), finally, the infant attempts to perform the task on his own (primary learning). In order to motivate the infant to learn and practice these skills, the parent physically plays with and verbally encourages the infant. The parent also provides toys so that the infant can play while learning and practising on his own. Typically, all of the infant's senses are utilized to teach and motivate him to learn.

Gross motor movement includes, but is not limited to, learning their own body scheme (where different parts of their body are); posture (the position of their body with respect to the surrounding space); proprioception (the position they are in ); co-ordinating the muscles of their gross motor system (to sit, walk, etc.); and vestibular movement (knowledge of and how to react to being up/down, spinning, falling, jumping, etc.). Herein the totality of those skills will be referred to as gross motor skills.

As the infant grows older, it is common to place him in a sitting position, initially with physical assistance to remain sitting, in order to teach the infant what a sitting position is like and to let him experience what can happen when in a sitting position. "U"-shaped cushions specifically adapted for supporting an infant in a sitting position are readily available. When an infant is about six months of age—more or less—it is common to place him in a sitting position and not provide supplemental support, in order to allow the infant to learn the gross motor skill of sitting without assistance.

When an infant is about six months of age—more or less—he can roll around on the floor and, eventually, pull himself around, ultimately progressing to crawling. As an infant progresses to the walking stage, it is common for an adult to hold the infant in an upright standing position by using their hands grasping around the infant's torso. The infant can then, through his own will, move his legs and arms, can bend forwardly, and so on, in order to learn gross motor skills by performing them. Familiar visual, tactile, and auditory feedback, combined with the security of being supported, provide sufficient confidence for the infant to learn through trial and error.

All of these gross motor skills are learned by trying various movements and receiving feedback from various senses regarding these movements, the infant's surroundings, and the results of the movements in the surroundings. In order for proper learning to take place, various senses produce feedback that permit the infant to learn. For instance, visual feedback permits the infant to know the location of various surroundings, and also whether parent is there for support; auditory feedback permits the infant to receive instructions, encouragement, and warnings from a parent, among other things; tactile feedback permits an infant to determine his specific whereabouts with respect to an object, such as a floor or something to hold on to; vestibular apparatus to provide feedback regarding orientation and balance; and so on.

As the infant learns through trial and error, during many hours of practice of various motor movements every day for several months, the infant is learning a great deal through all of his senses. All of the feedback information is received on an ongoing basis over a significant period of time, and is necessary to allow an infant to learn gross motor skills.

However, if an infant is blind or deaf, the amount of environmental stimulation, and thus motivation, is substantially reduced compared to sighted or hearing infants. If this same infant is also physically or mentally disabled, or both, the intake of information is reduced further still and may be processed in an unusual or faulty manner, thus making it even more difficult or seemingly difficult to learn. Accordingly, learning gross motor skills is typically more difficult and occurs at a later stage when the child is physically heavier, takes a longer time and more practice to learn, and puts a greater physical strain on the parent to support the child.

For instance, if an infant is visually impaired and, therefore, cannot receive significant visual feedback, he will have trouble establishing an upright orientation and will have difficulty knowing what his immediate surroundings are, except for what can be randomly felt. His only feedback is tactile (namely, touching his surroundings) and auditory (namely, receiving instructions, encouragement, and warnings from a parent). Accordingly, he lacks confidence and is very hesitant to move from a given "safe" position to an unknown position.

For an infant who is multi-sensory deprived, such as visually impaired and hearing impaired, there is neither significant auditory feedback nor significant visual feedback received. Typically, such an infant is even more hesitant to move from a given position than is an infant who is only single sensory deprived. Such hesitation to move from a given position may be even more pronounced when such an infant is in a standing position, where the gross motor skills needed to walk are quite complex. Indeed, to cast this task in a more familiar light, it is difficult for a full sensory, non-handicapped adult to learn a complicated motor skill, and such an adult typically learns a complicated motor skill, such as skating, for example, slowly and possibly hesitantly.

Some infants have special needs beyond the multi-sensory (visual and auditory) impairments, possibly also having physical or mental disabilities which impede their learning of gross motor skills. Such disabilities include Cerebral Palsy (CP), Downs Syndrome, and so on. These infants receive very minimal feedback about what happens as a result of gross motor movement, have difficulty in learning about their own bodies, are unsure about where their bodies begin and end, and are afraid to move out of any given position. It is extremely difficult to teach gross motor skills to such infants.

Indeed, it is believed by the medical profession at large, that multi-sensory deprived infants cannot fully learn gross motor skills, since they learn so slowly. The prevailing method within the medical profession at large to teach gross motor skills (i.e.: walking) to multi-sensory deprived and severely mentally and physically challenged infants and children involves placing the child in a supine orientation onto a mat on the floor. The infant's arm and legs are physically moved by an attendant to provide feedback about arm and leg movement, in hope that the child might, to some degree, try to emulate such movement. Such therapy typically takes place only one or twice a week, for perhaps half an hour at a time. In this way a child does not actually practice the gross motor skill to be learned. With such a manner of training, a child only learns through secondary learning, which is not as effective as primary learning, which is achieved by practising the specific gross motor skill themselves. Moreover, if a multi-sensory deprived child is blind, he cannot utilize tertiary learning (observing someone else performing the task or skill), thus further impeding the learning process. Moreover, a very insignificant amount of feedback is received, on an overall basis, and accordingly, multi-sensory deprived infants do not learn gross motor skills in this manner.

It can readily be seen that using therapy in this manner to teach gross motor skills even to a full sensory infant would produce very slow results, as the infant would not actually be practising the specific gross motor skill.

Another very important consideration in the development of a multi-sensory deprived infant is that of voluntary movement of various parts of his entire body to develop and to strengthen the muscles of the gross motor system for activities such as standing, jumping, spinning, and walking. Since such infants take much longer to learn and typically are active for only a brief portion of the day, it may take many months, or even years, to develop and strengthen the muscles of the gross motor system, and develop gross motor skills. Further, such difficulty in strengthening the body also extends to the lungs, heart, and so on.

In addition to gross motor skill training of multi-sensory deprived toddlers rehabilitative gross motor skill training—or, in other words rehabilitation—is often needed by toddlers, children, young adults, and even adults, who may have been injured in an accident, suffered a stroke, become blind, and so on.

It is an object of the present invention to provide an apparatus for supporting a motor-skill challenged human trainee while learning gross motor skills.

It is a further object of the present invention to provide an apparatus for supporting a multi-sensory deprived motor-skill challenged human trainee while learning gross motor skills.

Another object of the present invention is to provide an apparatus for supporting a multi-sensory deprived motor-skill challenged human trainee while permitting the specific practice of gross motor skills.

Yet another object of the present invention is to provide an apparatus for supporting a motor-skill challenged human trainee while permitting primary and secondary practice of gross motor skills.

It is another object of the present invention to provide an apparatus for supporting a motor-skill challenged human trainee while permitting the exercise of their gross motor muscles and strengthening of their cardiovascular, respiratory, and circulatory systems.

It is yet another object of the present invention to provide an apparatus for supporting a motor-skill challenged human trainee in a manner that permits and encourages substantially lengthy periods of training and exercise, while reducing the physical stress on the human trainee.

It is still another object of the present invention to provide an apparatus that permits a motor-skill challenged human trainee, such as those who are multi-sensory deprived or have physical or mental disabilities, including toddlers, children, young adults, and adults, to learn, practice, and maintain gross motor skills.

A further object of the present invention is to provide a rehabilitation device.

It is a still further object of the present invention to provide an apparatus for supporting a motor-skill challenged human trainee while learning gross motor skills, wherein the apparatus is suspended from an elevated support structure.

Another object of the present invention is to provide an apparatus for supporting a motor-skill challenged human trainee while learning gross motor skills, wherein the human trainee is in an upright orientation.

A still further object of the present invention is to provide an apparatus for supporting a motor-skill challenged human trainee while learning gross motor skills, wherein the human trainee is in an upright orientation, and wherein the human trainee cannot tip the apparatus over.

DESCRIPTION OF THE PRIOR ART

Various prior art devices are known to be used in teaching gross motor skills to infants, children, and so on, with and without mental and/or physical disabilities and impairments.

Prone standers are used by medical professionals (such as physiotherapists) to support and maintain a sensory deprived child while the professional moves the child's limbs. The prone stander comprises a padded prone board and a plurality of adjustable straps. Once the child is strapped in, the board is raised to a semi-upright position. The intent is ultimately to get the child off the floor and into a strictly upright position, so that they can appear to interact in a somewhat normal manner. Prone standers do not allow an infant to move, other than movement of their arms. Further, it has been found that the pressure of the board on their chest tends to cause fluid build-up in the lungs, which can be extremely detrimental to a person of limited strength and mobility.

Corner seats are essentially corner-shaped benches with a tray in the front. The intent of a corner-seat is to get an infant into a position other than supine, in order make him more aware of his environment. It does not allow independent movement and does not strengthen the muscles or pulmonary function, and does not contribute significantly to the learning of gross motor skills.

Walkers come in many shapes and forms, but basically are an aid that supports the upper body of a child who can walk to at least some degree. Typically, the child is strapped into the walker while sitting on a seat that is suspended in the centre of the walker, thereby allowing the child to walk with support. Such walkers are intended for use by children who have milder forms of congenital syndromes and physical disabilities, and are not intended for use by the severely afflicted.

Hammock swings are essentially a hammock that permits an infant or child to be swung gently in order for the infant or child to experience vestibular movement. It is not intended to allow an infant or child to move without help, and is used for infants and children with severe forms of syndromes and disabilities because of the lack of any other types of aids suitable to their needs.

Baby bouncers come in various shapes and structures, but are essentially all similar in that they comprise a lightweight seat structure, usually made of heavy cloth, which seat structure receives the pelvis area of an infant with the infant's feet extending downwardly from the seat structure. The seat structure is suspended from a door frame or the like by two or more straps and additional mounting means. Also necessarily included is a spring to permit an infant in the seat structure to jump upwardly from the floor and come back down to the floor gently enough to prevent injury, and also to jump high enough to allow for full leg extension and full enjoyment.

Such baby bouncers are quite lightweight in order to permit a child to bounce up and down and generally to allow a child to move laterally quite readily.

The most relevant prior art baby bouncer is that marketed by Graco Children's Products Inc., and is known as the Bumper Jumper™. This baby bouncer is also shown in U.S. Design Pat. No. 336,994.

A specific apparatus that performs the stated objects of the present invention is not available at the present time.

SUMMARY OF THE INVENTION

In accordance with one aspect of the present invention, there is provided a suspended motor-skill training apparatus for receiving and retaining a motor-skill challenged human trainee and to permit the human trainee to learn gross motor skills. The apparatus comprises a substantially solid and weighty main body member having a front end and a back end. The main body member defines in horizontally surrounding relation a hollow central region open for vertical passage therethrough, which hollow central region is sized to permit the legs and pelvis of a trainee to pass therethrough. The main body member has left and right forwardly disposed attachment points and at least one rearwardly disposed attachment point, the attachment points being spaced apart and defining a geometric centre disposed within the hollow central region. The main body member has its centre of gravity disposed substantially centrally between and rearwardly of the left and right forwardly disposed attachment points. At least three strap members, having lower and upper ends, are connected at their respective lower ends one to each of the at least three spaced apart attachment points and are operatively connected at their respective upper ends to a suspension means mounted on an elevated support structure. The suspended motor-skill training apparatus may be suspended by the suspension means from the elevated support structure. A seating means is operatively mounted on the substantially solid main and weighty body member in depending relation therefrom such that the pelvic area of a trainee is received by the seating means below the substantially solid and weighty main body member and such that the centre of gravity of the trainee is at an elevation adjacent or below the main body member, with the legs of the trainee extending below the seating means and the trainee facing forwardly in a substantially upright position. When the trainee leans outwardly over a portion of the main body member, the trainee is physically precluded from falling out of the suspended motor-skill training apparatus by the main body member. The combined centre of gravity of the trainee and the main body member remains within the triangle defined by the attachment points on the main body member due to the weight of the main body member and the weight of the trainee, and remains at an elevation adjacent or below the main body member, thus precluding the suspended motor-skill training apparatus from tipping more than a minor amount. A motor-skill challenged human trainee seated in the suspended motor-skill training apparatus can learn gross motor skills through repetitive motion, with the risks of injury and falling out being precluded.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
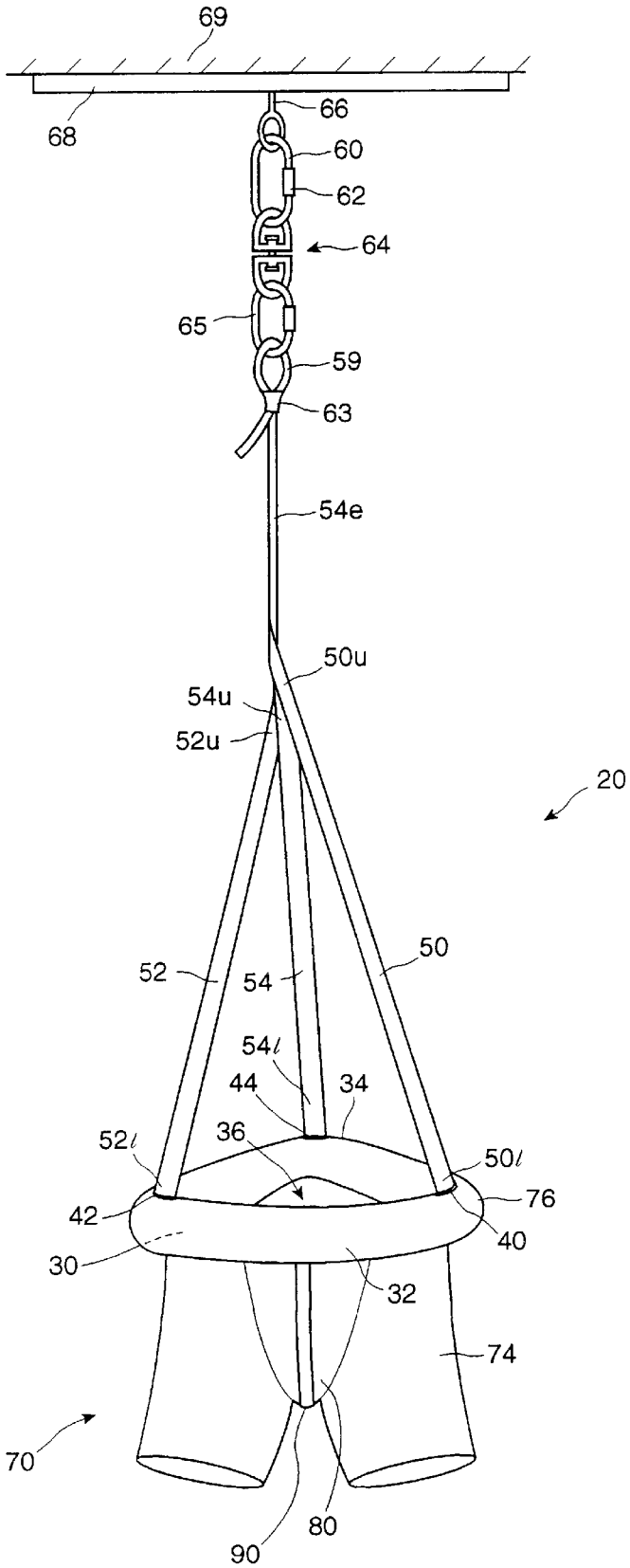
FIG. 1 is a front elevational view of the preferred embodiment of the suspended training apparatus of the present invention, suspended from an elevated support structure.
Figure 3:
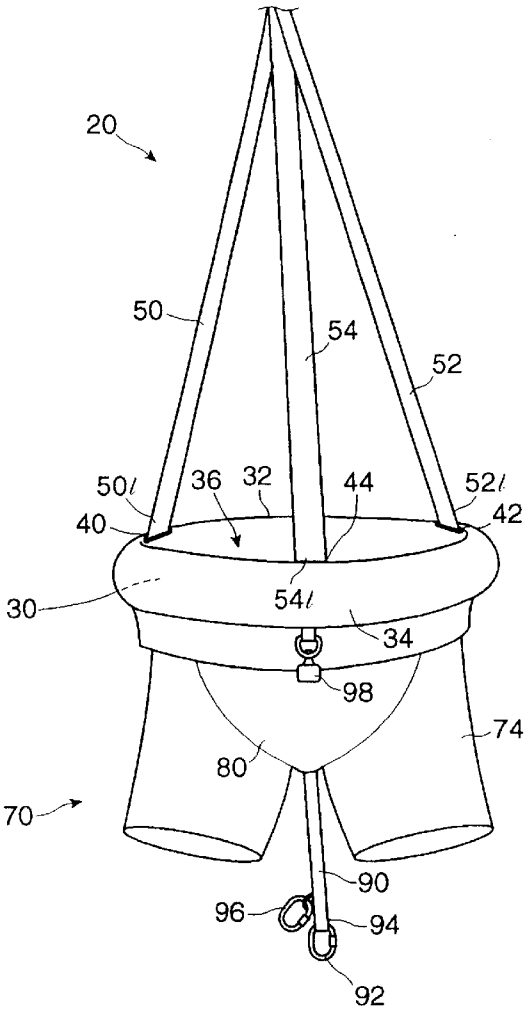
FIG. 3 is a rear elevational view of a portion of the suspended training apparatus of FIG. 1.
Figure 2:
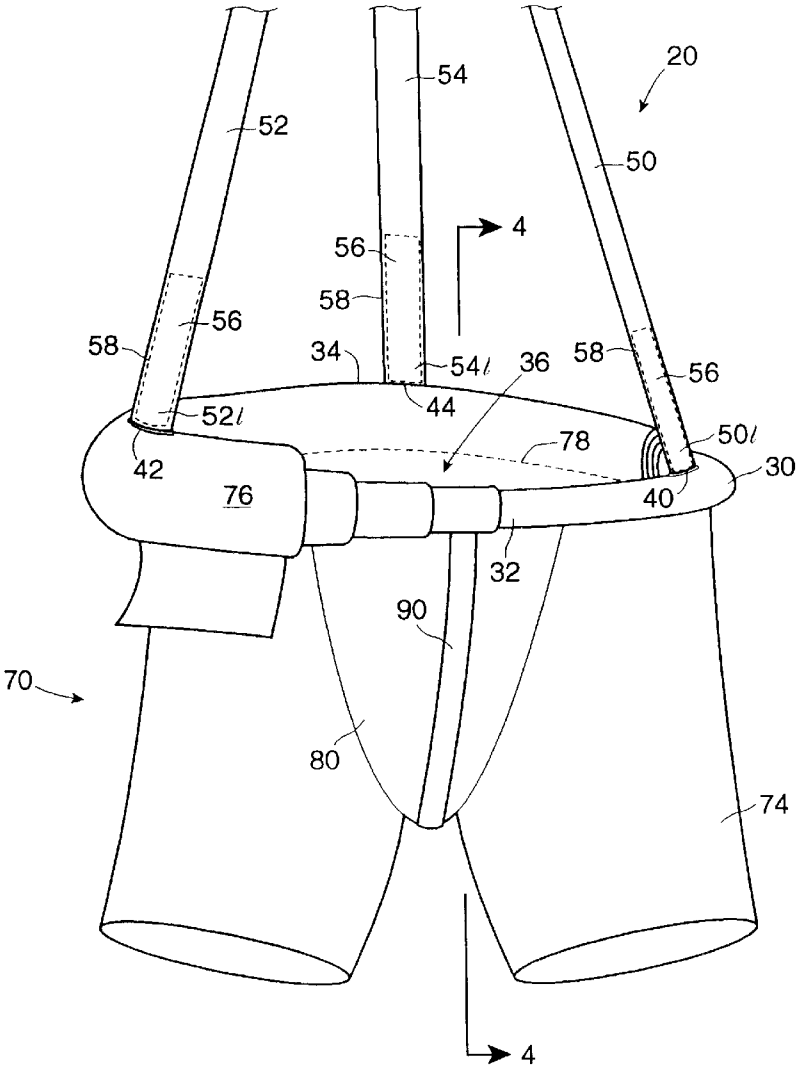
FIG. 2 is an enlarged front elevational view of a portion of the suspended training apparatus of FIG. 1, with parts of the apparatus partially removed for the sake of clarity.

Reference will now be made to FIGS. 1 through 6, which show a preferred embodiment of the suspended motor skill training apparatus of the present invention, as indicated by the general reference numeral 20. The suspended motor skill training apparatus is for receiving and retaining a motor-skill challenged human trainee, as can be best seen in FIG. 6, and to permit the human trainee to learn gross motor skills by actually performing movements of the limbs and, to a lesser degree, movement of the torso. Such movement of the limbs and of the torso also provides exercise for strengthening of the muscles used for gross motor skills and also for general strengthening of the body, the heart, the lungs, and so on.

The suspended motor skill training apparatus 20 comprises a substantially solid and weighty main body member 30. In the preferred embodiment, the main body member 30 is substantially planar, which plane is oriented substantially horizontally in normal use of the suspended motor skill training apparatus 20.

The main body member 30 has a front end 32 and a back end 34, and defines in horizontally surrounding relation a hollow central region 36. The hollow central region 36 is open for vertical passage therethrough and is sized to permit the legs and pelvis of a trainee to pass therethrough. Ideally, the main body member 30 should be sized to permit the legs and pelvis of an adult to pass therethrough. It has been found that a suspended motor skill training apparatus 20 having a main body member 30 this size still properly accommodates a toddler.

In the preferred embodiment, the main body member 30 is substantially annular in shape—that is to say that, in the preferred embodiment as illustrated, there are no gaps in the main body member 30; however, in an alternative embodiment of the main body member, there can be a gap, if desired, but the gap must not permit the trainee to fall out.

Figure 5:
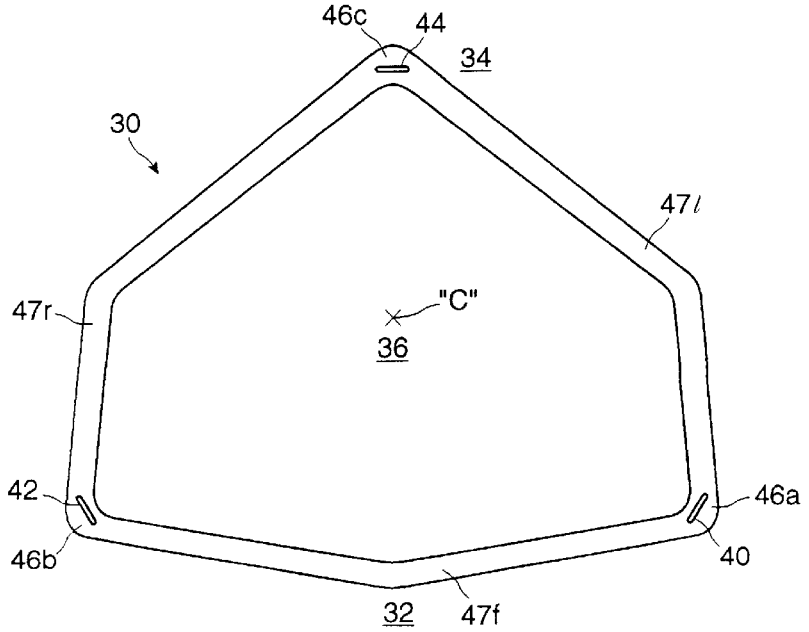
FIG. 5 is a top plan view of the main body member of the suspended training apparatus of FIG. 1.

In the preferred embodiment as illustrated, and as can best be seen in FIG. 5, the main body member 30 is triangularly shaped, having a front leg 47*f*, a left leg 47*l*, and a right leg 47*r*, adjoined one to the next with by vertices 46*a*, 46*b*, and 46*c*, and with the triangular shape being that of equilateral triangle. Further, in order to comfortably accommodate the torso of a trainee, the legs of the triangle are slightly convexly curved or bent.

The substantially solid and weighty main body member 30 preferably has a weight of at least about two kilograms, or possibly slightly less, and probably somewhat more, depending on the weight of the human trainee to be accommodated by the suspended motor skill training apparatus 20; however, while it is preferable to have the main body member 30 more weight for purposes of increased stability, it is desirable in many cases to limit the main body member 30 to about three kilograms for toddler trainees, especially beginners who have not yet developed the motor skills necessary to move a heavier main body member 30. In order to achieve such weight, the main body member 30 is preferably made from metal and, in the preferred embodiment, the main body member 30 is made from stainless steel. For ease of manufacture, round stainless steel stock is cut into three lengths, with each of the lengths being bent to form the slightly curved legs of the triangle, and they are welded together at vertices 46*a*, 46*b*, and 46*c*. For the sake of comfort, a padding 38, preferably a closed cell foam, is disposed around the main body member 30, as can be best seen in FIG. 4.

The main body member 30 has a left forwardly disposed attachment point 40 located at the vertex 46*a* between the left leg 47*l* of the triangle and the front leg 47*f* of the triangle, and a right forwardly disposed attachment point 42 located at the vertex 46*b* between the right leg 47*r* of the triangle and the front leg 47*f* of the triangle. There is also at least one rearwardly disposed attachment point—in the preferred embodiment, there is one rearwardly disposed attachment point 44 disposed at the rear vertex 46*c* of the triangularly shaped main body member, between the left leg 47*l* and the right leg 47*r*. The attachment points are spaced apart one from another and define a geometric centre "C" disposed within the hollow central region 36, as can be best seen in FIG. 5. The three attachment points 40, 42, 44 comprise inverted "U"-shaped metal loops welded to the main body member 30.

Figure 4:
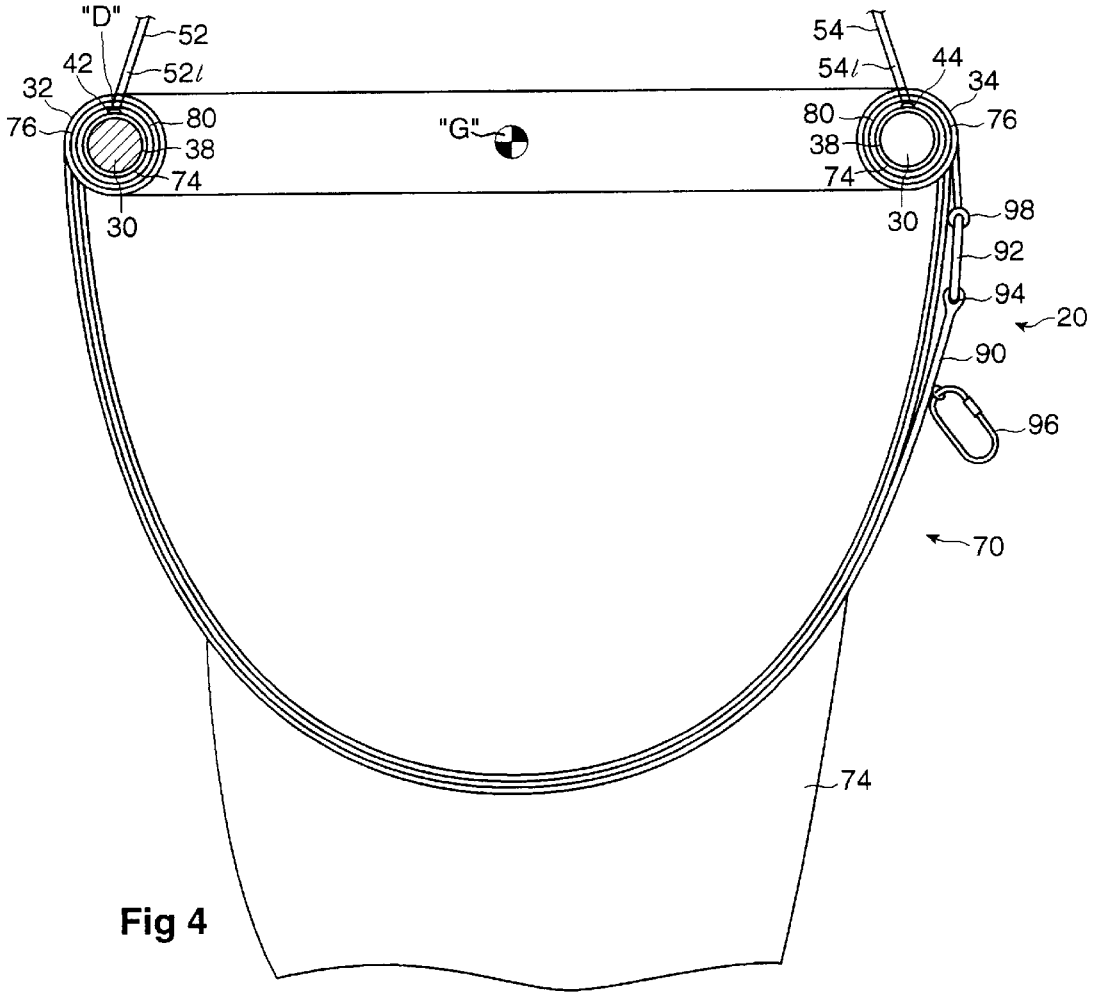
FIG. 4 is a sectional side elevational view of a portion of the suspended training apparatus of FIG. 1, taken along section line 4—4 of FIG. 2.
Figure 6:
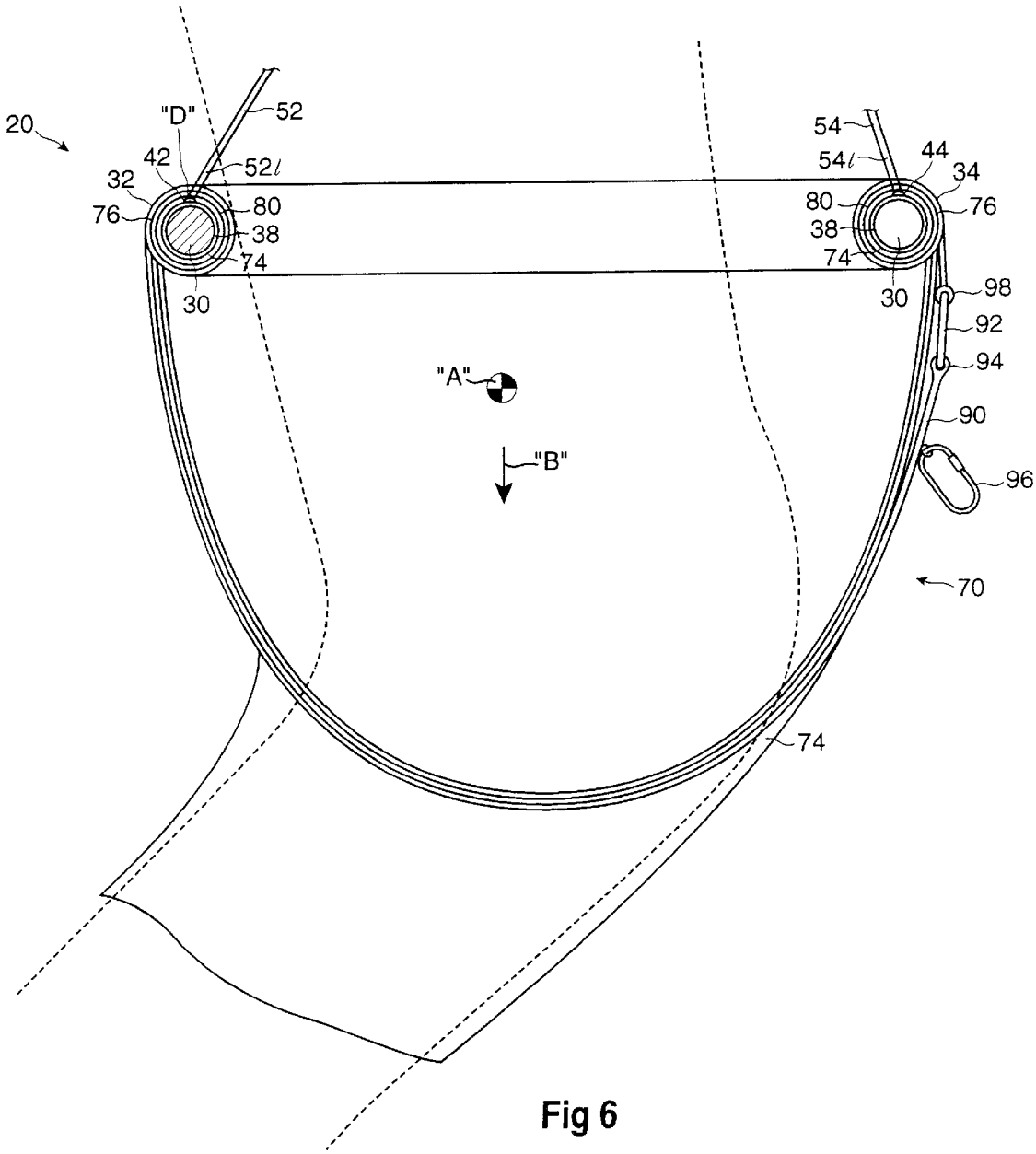
FIG. 6 is a sectional side elevational view, similar to FIG. 4, with an infant sitting in the suspended training apparatus and leaning forwardly.

As can be best seen in FIG. 4, the centre of gravity "G" of the main body member 30 is disposed substantially centrally within the hollow central region 36 between the left and right forwardly disposed attachment points 40, 42, and also disposed rearwardly of the left and right forwardly disposed attachment points 40, 42. In this manner, the weight of the substantially solid and weighty main body member 30 counteracts the weight of the upper part of a torso of a human trainee who might lean outwardly over a portion of the main body member 30, perhaps forwardly over the front leg 47*f* of the main body member 30, as is depicted in FIG. 6.

At least three strap members—and, in the preferred embodiment, exactly three strap members 50, 52, 54—are used to help suspend the suspended motor skill training apparatus 20. The strap members 50, 52, 54 have respective lower ends 501, 521, 541, and respective upper ends 50*u*, 52*u*, 54*u*. The straps are preferably made from nylon or other similar high tensile strength material, and have reinforcing portions 56 disposed at their lower ends 501, 521, 541. The lower ends 501, 521, 541 of the strap members are looped around and secured together, and secured to the reinforcing portions 56 by stitching 58.

The strap members 50, 52, 54 are connected at their respective lower ends 501, 521, 541 one to each of the attachment points 40, 42, 44, around the respective metal loops, and are also operatively connected at their respective upper ends 50*u*, 52*u*, 54*u* to a suspension means preferably comprising a hook member 60. In the preferred embodiment, two of the three straps 50, 52, 54 are sewn at their upper ends to the other of the three straps, which other strap extends upwardly, as indicated by reference numeral 54*e*, to terminate in a top loop 59, as retained by a buckle 63, engaging eyelets 55 in the strap portion 54*e*, so as to provide height adjustability for the suspended motor-skill training apparatus 20.

The hook member 60 is a special type of safety hook commonly referred to as a QUICK LINK™ hook and has a closure member 62 threadibly engaged on the main body of the hook. The closure member 62 is included for safety reasons and essentially precludes the hook from being unwantedly removed. Further, the suspension means comprises a swivel member 64 mounted in seriatim with the hook member 60, to permit rotation of the suspended motor skill training apparatus 20. The swivel member 64 is optionally connected to the top loop 59 of the strap members 50, 52, 54 by means of a second QUICK LINK™ hook 65, so that the swivel member 64 may be readily connected to and disconnected from the top loop 59. Other components, such as a spring or a bungee cord, may be included in addition to or in place of the swivel member 64, as desired.

The suspension means, namely the hook 60, is mounted on an elevated support structure which, in the preferred embodiment as illustrated, comprises an eyebolt 66, mounted on a re-enforcing member 68 on ceiling 69. In this manner, the suspended motor skill training apparatus 20 may be suspended by the suspension means from an elevated support structure, thus permitting the suspended motor skill training apparatus 20 to receive and retain a human trainee in a substantially upright orientation with the plane of the main body member being substantially horizontal, and so as to permit a trainee to touch the floor below (not shown) with his feet. As an alternative to the eyebolt 66, a track or rail may be used if a larger area of mobility is desired.

If desired, a safety strap (not illustrated) may be interconnected between the eyebolt 66, or a second eyebolt also mounted in the reinforcing member 68, and the three strap members 50, 52, 54, preferably where the strap members 50, 52, 54 converge and join one to the other.

The suspended motor skill training apparatus 20 further comprises a seating means, as indicated by the general reference numeral 70. The seating means 70 is operatively mounted on the substantially solid and weighty main body member 30 in depending relation therefrom such that the pelvic area of a trainee is received by the seating means 70 below the main body member 30 and such that the centre of gravity of the trainee is at an elevation adjacent or below the main body member 30. As can be best seen in FIG. 6, the legs of the human trainee extend below the seating means 70, and the seating means 70 is mounted on the main body member 30 such that a human trainee faces forwardly in a substantially upright position. The seating means 70 comprises at least a span of cloth securely attached to the main body member adjacent the front and back ends 32, 34 thereof and, in the preferred embodiment, the seating means 70 comprises a span of cloth in the form of a pair of short pants 74 secured to the main body member 30 around its entire perimeter, for maximum supporting strength of the short pants 74. As can be best seen from FIG. 4, the top portion of the short pants 74 is looped around the main body member 30, exteriorly to the closed cell foam padding 38, and is secured in place by robust stitching (not shown). The short pants 74 are preferably made from fleece cotton, or the like, for purposes of comfort and absorbency. An outer cover 76 may be secured in place by robust stitching 78, as can be best seen in FIG. 2.

The seating means 70 further comprises a fabric gusset 80 disposed exteriorly in supporting relation to the cloth short pants 74. The fabric gusset 80 is attached to the main body member 30 in a manner similar to that of the short pants 74, but only at the front and back ends 32, 34 of the main body member 30. The fabric gusset 80 is made from a strong cloth material, such as denim, canvas, or the like, to structurally reinforce the seating means 70, for supporting a human trainee.

The seating means 70 further comprises an adjustable length strap 90 also secured around the main body member 30 in the same manner as the short pants 74 and the fabric gusset 80, at the front and back ends 32, 34 of the main body member 30. The adjustable length strap 90 is disposed exteriorly in supporting relation to the fabric gusset 80 so as to permit selected adjustment of the depth of the seating means 70. The adjustable length strap 90 also comprises a first position QUICK LINK™ hook 92 located at the free end 94 of the adjustable length strap 90 and a second position QUICK LINK™ hook 96 located on the adjustable length strap 90 about ten centimeters from the free end 94 thereof. The first position and second position QUICK LINK™ hooks 92, 96 are removably connectable onto a co-operating buckle 98 secured to the main body member 30 at the back end 34 thereof, to provide means of adjusting the effective length of the adjustable length strap 90, thereby permitting selective adjustment of the depth of the seating means 70. In this manner, a growing toddler, or different sizes of individuals, may be accommodated by the seating means 70.

In use, when a human trainee seated in the seating means 70 leans outwardly over a portion of the main body member 30, the human trainee is physically precluded from falling out of the suspended motor skill training apparatus 20 by the main body member 30, as can best be seen in FIG. 6. As can also be best seen in FIG. 6, the combined centre of gravity of the human trainee and the main body member, as indicated by indicator "A", remains within the triangle defined by the attachment points 40, 42, 44 on the main body member 30 due to the weight of the main body member 30 and the weight of the human trainee, and also remains at an elevation adjacent or below the main body member 30. The combined weights act together at the combined centre of gravity "A" as a moment arm, as indicated by the downwardly facing arrow "B", about a pivot axis passing through the left and right front attachment points 40 and 42, to counteract the weight of any portion of the upper portion of the torso or the head of the human trainee that might be displaced forwardly of the pivot axis "D". Accordingly, the main body member 30 remains substantially level, thus precluding the suspended motor skill training apparatus 20 from tipping more than a minor amount. Moreover, the combined centre of gravity "A" remains at an elevation adjacent or below the main body member 30. The combined centre of gravity "A" is below the main body member 30, as is at least partially determined by the depth of the seating means 70, the less chance there is of the suspended motor skill training apparatus 20 from tipping or of the trainee from falling out, even without tipping of the suspended motor skill training apparatus 20.

In this manner, a motor skill challenged human trainee seated in the suspended motor skill training apparatus 20 can learn gross motor skills through repetitive motion, of the upper and lower limbs and even the torso to some degree, with the risks of injury and falling out being precluded. Even a multi-sensory deprived toddler can more readily learn essentially where his body begins and ends, can learn gross motor skills, and can learn to react with his environment in a positive way, all of which was considered virtually impossible prior to the existence of the suspended motor skill training apparatus 20 of the present invention.

Other modifications and alterations may be used in the design and manufacture of the apparatus of the present invention without departing from the spirit and scope of the accompanying claims.

What is claimed is:

1. A suspended motor-skill training apparatus for receiving and retaining a motor-skill challenged human trainee and to permit said human trainee to learn gross motor skills, said apparatus comprising:

a substantially solid and weighty main body member having a front end and a back end, and defining in horizontally surrounding relation a hollow central region open for vertical passage therethrough and sized to permit the legs and pelvis of a trainee to pass therethrough, said main body member having left and right forwardly disposed attachment points and at least one rearwardly disposed attachment point, said attachment points being spaced apart and defining a geometric centre disposed within said hollow central region;

wherein said main body member has its centre of gravity disposed substantially centrally between and rearwardly of said left and right forwardly disposed attachment points;

at least three strap members having lower and upper ends and being connected at their respective lower ends one to each of said at least three spaced apart attachment points and operatively connected at their respective upper ends to a suspension means, mounted on an elevated support structure, whereby said suspended motor-skill training apparatus may be suspended by said suspension means from said elevated support structure;

seating means operatively mounted on said substantially solid and weighty main body member in depending relation therefrom such that the pelvic area of a trainee is received by said seating means below said substantially solid and weighty main body member and such that the centre of gravity of said trainee is at an elevation adjacent or below said main body member, with the legs of said trainee extending below said seating means and said trainee facing forwardly in a substantially upright position;

wherein, when said trainee leans outwardly over a portion of said main body member, said trainee is physically precluded from falling out of said suspended motor-skill training apparatus by said main body member; and wherein the combined centre of gravity of said trainee and said main body member remains within the triangle defined by said attachment points on said main body member due to the weight of said main body member and the weight of the trainee, and remains at an elevation adjacent or below said main body member, thus precluding said suspended motor-skill training apparatus from tipping more than a minor amount;

whereby a motor-skill challenged human trainee seated in said suspended motor-skill training apparatus can learn gross motor skills through repetitive motion, with the risks of injury and falling out being precluded.

2. The suspended motor-skill training apparatus of claim 1, wherein said main body member is substantially planar.

3. The suspended motor-skill training apparatus of claim 2, wherein said main body member is substantially annular in shape.

4. The suspended motor-skill training apparatus of claim 3, wherein said main body member is triangularly shaped.

5. The suspended motor-skill training apparatus of claim 4, wherein said triangle is an equilateral triangle.

6. The suspended motor-skill training apparatus of claim 5, wherein the legs of the triangle are slightly convexly curved.

7. The suspended motor-skill training apparatus of claim 1, wherein said main body member has a weight of at least two kilograms.

8. The suspended motor-skill training apparatus of claim 7, wherein said main body member is made from metal.

9. The suspended motor-skill training apparatus of claim 8, further comprising padding disposed around said main body member.

10. The suspended motor-skill training apparatus of claim 9, wherein said padding comprises closed cell foam.

11. The suspended motor-skill training apparatus of claim 1, wherein there is only one rearwardly disposed attachment point.

12. The suspended motor-skill training apparatus of claim 11, wherein the three attachment points are attached one attachment point at each vertex of a triangularly shaped main body member.

13. The suspended motor-skill training apparatus of claim 1, wherein said suspension means comprises a hook member.

14. The suspended motor-skill training apparatus of claim 13, wherein said suspension means further comprises a swivel member mounted in seriatim with said hook member.

15. The suspended motor-skill training apparatus of claim 14, wherein said straps are substantially non-elastic.

16. The suspended motor-skill training apparatus of claim 1, wherein said seating means comprises a span of cloth securely attached to said main body member adjacent the front and back ends thereof.

17. The suspended motor-skill training apparatus of claim 1, wherein said seating means comprises a span of cloth in the form of a pair of short pants secured in the main body member around its entire perimeter.

18. The suspended motor-skill training apparatus of claim 17, further comprising a fabric gusset disposed exteriorly in supporting relation to said cloth short pants.

19. The suspended motor-skill training apparatus of claim 18, further comprising an adjustable length strap disposed exteriorly in supporting relation to said fabric gusset, so as to permit selected adjustment of the depth of the said seat means.

* * * * *